United States Patent [19]

Terjesen

[11] Patent Number: 4,955,088

[45] Date of Patent: Sep. 11, 1990

[54] UNDERWEAR STRUCTURE

[76] Inventor: John W. Terjesen, Rte. 1, Box 261A, Brevard, N.C. 28712

[21] Appl. No.: 306,048

[22] Filed: Feb. 6, 1989

[51] Int. Cl.[5] ..... A41B 9/02

[52] U.S. Cl. ..... 2/403

[58] Field of Search ..... 2/405, 403, 404; 128/159

[56] References Cited

U.S. PATENT DOCUMENTS

| | | | |
|---|---|---|---|
| 2,601,602 | 6/1952 | Firsching, Sr. | 2/404 X |
| 3,459,181 | 8/1969 | Mann | 2/403 X |
| 3,487,833 | 1/1970 | Senser | 128/159 |

*Primary Examiner*—Werner H. Schroeder
*Assistant Examiner*—Diana L. Biefeld
*Attorney, Agent, or Firm*—Bailey & Hardaway

[57] ABSTRACT

A male undergarment having a waistband at the top thereof, thigh encircling leg portions at the bottom thereof and a crotch portion between the leg and circling portions with the improvement in the form of a rectangular section of fabric attached at the leg portions and at the bottom thereof near the crotch portion to define a pouch between the leg portions for the placement of the male sex organ therein and isolation of the sex organ from the remainder of the interior of the underwear structure.

3 Claims, 2 Drawing Sheets

UNDERWEAR STRUCTURE

BACKGROUND OF THE INVENTION

This invention relates generally to the art of apparel and, more particularly, to an improved article of male underwear.

A variety of underwear structures have been available in the prior art for normal wear by males. These types of underwear are generally of the "jockey" type or boxer type. A variety of modifications have been made to such structures in order to alleviate sexual malfunction disorders. Such types of devices are described in U.S. Pat. No. 4,471,772 to Taylor C. Miller and U.S. Pat. No. 3,511,234 to P. M. Larson. Other underwear structures, however, are disclosed in U.S. Pat. Nos. 2,822,807 and 2,139,532.

While such structures are complex but effective, they have not addressed the problem of improving the comfort and prolonging the comfort to the wearer.

SUMMARY OF THE INVENTION

It is an object of this invention to provide an improved underwear structure for male use.

It is a further object of this invention to provide such an improved underwear structure which prolongs and enhances comfort to the wearer thereof.

These as well as other objects are accomplished by a male undergarment having a waistband at the top thereof, thigh encircling leg portions at the bottom thereof and a crotch portion between the leg encircling portions with the improvement in the form of a rectangular section of fabric attached at the leg portions and at the bottom thereof near the crotch portion to define a pouch between the leg portions for the placement of the male sex organ and testicles therein and partial isolation of the sex organ from the remainder of the interior of the underwear structure. The pouch is like a shelf or ledge as it is not large enough to completely encircle the testicles and penis.

DETAILED DESCRIPTION

In accordance with this invention, it has been found that a simple improvement may be made to a pair of mens underwear to greatly prolong and enhance the comfort thereof. In particular, the structure of this invention has been found to eliminate the need for readjustment of underwear structures and of the male sex organ during periods of prolonged inactivity, for example, during periods of long driving. Various other advantages and features will become apparent from the reading of the following description given with reference to the various figures of drawings.

Figure 1:
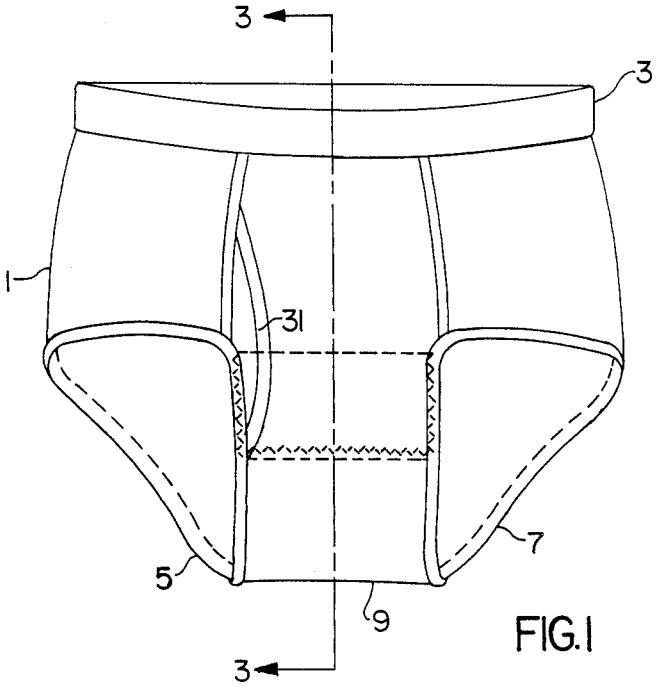
FIG. 1 of the drawings is front view of a "jockey" type underwear in accordance with this invention.

FIG. 1 of the drawings illustrates an underwear structure 1 in accordance with this invention. The underwear structure as illustrated in FIG. 1 is a front view with FIG. 2 being a partial cutaway isometric view thereof. As illustrated in FIG. 1 the underwear structure has the conventional elements of a waistband 3, leg portions 5 and 7, and a crotch portion 9. The underwear as illustrated in FIGS. 1 through 3 is generally of the "jockey" type.

The improvement according to this invention is a rectangular section of fabric 11 positioned intermediate the waistband 3 and crotch portion 9 and stitched adjacent the leg sections 5 and 7 at 13 and 15. The section of fabric 11 is also stitched across the bottom thereof at 17 to generally form a pouch between the fabric section 11 and a front panel 19 of the underwear structure 1. The pouch 21 defined thereby may be best illustrated in FIG. 3. The purpose of the pouch 21 is for the placement of the penis and testicles between the front panel 19 and the fabric section 11. The male sex organ may be positioned in a variety of positions and directions to provide comfort for the wearer and perhaps improve circulation within the male sex organ because of the use of the improved structure of this invention. It has surprisingly been found that the comfort provided by the structure of this invention endures for a significantly extended period of time much greater than that provided by prior art structures. This endurance or prolonged comfort eliminates the need for shifting and rearranging periodically so as to maintain a high level of comfort.

Figure 2:
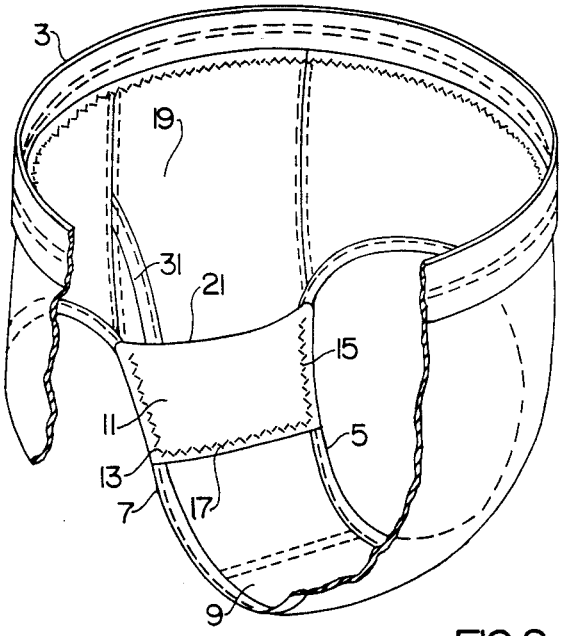
FIG. 2 is isometric partial cutaway view of the garment shown in FIG. 1.
Figure 3:
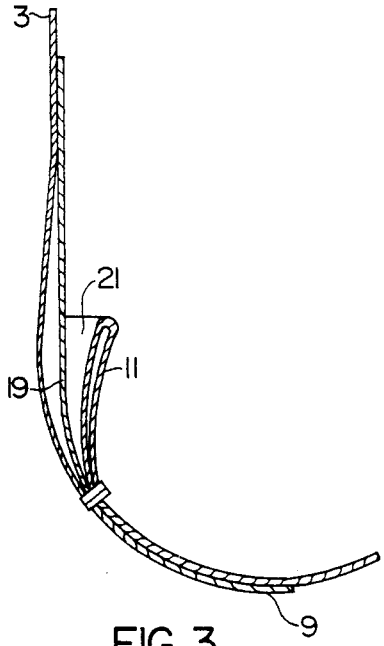
FIG. 3 of the drawings is a cross-section view along the line 3—3 of FIG. 1.

The FIGS. 1 through 3 embodiment also illustrates therein a conventional fly structure 31 on the front panel 19 immediately adjacent the pouch 21. This fly structure is utilized in the conventional manner.

Figure 5:
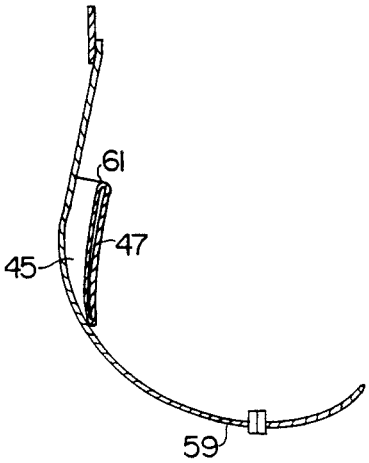
FIG. 5 is a cross-sectional view along the line 5—5 of FIG. 4.
Figure 4:
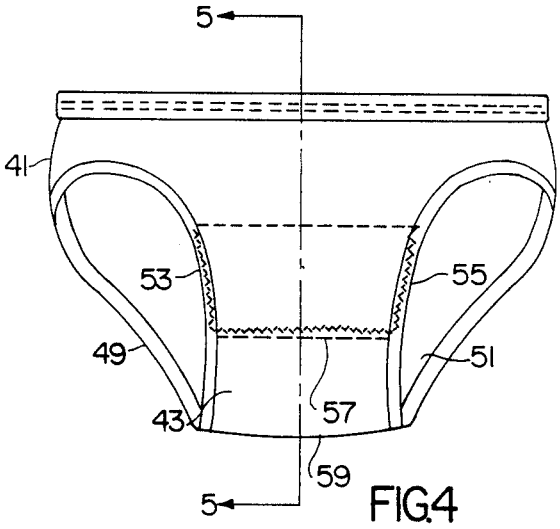
FIG. 4 of the drawings is a front view in partial phantom of another embodiment of this invention.

Another embodiment is illustrated in FIGS. 4 and 5 wherein an underwear structure 41 has a front panel 43 without a fly structure therein. As illustrated in FIG. 5, which is a cross-section view along the line 5—5 of FIG. 4, a pouch 45 is formed by a rectangular section 47 which is attached adjacent to leg structures 49 and 51 at 53 and 55. The rectangular section 47 is also attached at the bottom thereof at 57 above the crotch 59 of the underwear 41. The pouch of this embodiment is used in the same manner as the pouch of the FIGS. 1 through 3 embodiment.

As best illustrated in the cross-section view of FIG. 5 it is preferred to use a double section of fabric within the section 47. This leaves a fold 61 the top of the section in the unattached area defining the opening of pouch 45. This eliminates stitching in this area and further promotes comfort as well as eliminating the potential for raveling in this area.

It is thus seen that the improved underwear structure in accordance with this invention provides a novel structure not heretofore available in the prior art. As many variations will become apparent to those of skill in the art from a reading of the above description which is exemplary in nature so variations are embodied within the scope of this invention as defined by the following appended claims.

That which is claimed is:

1. In a man's support type undergarment having a front panel, a waistband at the top of the garment, thigh encircling leg portions at the bottom of the garment and a crotch portion between said leg portions, the improvement comprising:

a generally rectangular section of fabric stitched behind said front panel along said leg portions and across the bottom thereof above said crotch portion with a top of said rectangular section being unstitched to the undergarment and defining a ledge extending between said leg portion and above said crotch whereby the male sex organ is rested upon said ledge and generally isolated from the remaining interior of the undergarment.

2. The improvement according to claim 1 further including a fly portion opposite said ledge on said front panel.

3. The improvement according to claim 1 wherein said rectangular section of fabric is dual layered and folded at its uppermost edge.

* * * * *